US006078345A

United States Patent [19]

Yamakawa et al.

[11] Patent Number: 6,078,345

[45] Date of Patent: Jun. 20, 2000

[54] PAPER TRANSPORT DEVICE FOR THERMAL PRINTER

[75] Inventors: Kenji Yamakawa; Ryo Imai, both of Saitama, Japan

[73] Assignee: Fuji Photo Film Co., Ltd., Kanagawa, Japan

[21] Appl. No.: 08/888,329

[22] Filed: Jul. 3, 1997

[30] Foreign Application Priority Data

Jul. 4, 1996 [JP] Japan ..... 8-175220
Jul. 15, 1996 [JP] Japan ..... 8-185111

[51] Int. Cl.[7] ..... B41J 13/036

[52] U.S. Cl. ..... 347/218; 347/220

[58] Field of Search ..... 347/218, 220; 400/649, 654, 619, 642, 120.04; 271/272, 273

[56] References Cited

U.S. PATENT DOCUMENTS 5,179,390 1/1993 Yokoyama et al. ..... 400/619
5,629,729 5/1997 Fujishiro ..... 347/175
5,743,663 4/1998 Imai ..... 400/120.04

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

In a thermal printer having a stationary thermal head and a platen movable between a pressing position on the thermal head and a retracted position off the thermal head, a paper transport device is provided with a platen shift device for shifting the platen between the retracted position and the pressing position, a feed roller device for transporting the recording paper to the thermal head along a transport path, and a guide member disposed between the feed roller device and the thermal head. The guide member is movable in cooperation with the platen shift device, such that when the platen shift device shifts the platen to the retracted position the guide member moves to a guide position in the transport path and guides the recording paper to remove slantwise from the thermal head while passing through between the thermal head and the platen. When the platen shift device shifts the platen to the pressing position the guide member moves to an ineffective position off the transport path.

29 Claims, 11 Drawing Sheets

PAPER TRANSPORT DEVICE FOR THERMAL PRINTER

BACKGROUND OF THE INVENTION

1. Field of the Invention

The present invention relates to a paper transport device for a thermal printer with a thermal head, especially to a color thermal printer wherein recording paper is transported alternately in a recording direction and in the opposite direction through the thermal head while the thermal head records one color frame at one transport in the recording direction, to record at least three color frames in a recording area.

2. Background Arts

In a color thermal printer, at least three color frames are sequentially recorded in a recording area on the recording paper. To prevent the color failure, accurate registration between the color frames is required, so the positioning of the recording area relative to a heating element array of the thermal head should also be accurate. Especially where the recording paper is transported repeatedly back and forth through the thermal head, a feed roller device consisting of a capstan roller and at least a press roller is disposed in proximity to the thermal head for more accurate control on the paper transportation.

There are two types in those thermal printers having the feed roller device: one has a stationary platen and a thermal head movable between a pressing position for pressing its heating elements on the recording paper and a retracted position, and the other has a stationary thermal head and a platen movable between a pressing position for pressing the recording paper onto the heating elements and a retracted position. The former type using the movable thermal head has a problem in that the load applied to the recording paper varies more largely by the contact and removal of the thermal head, compared with the load variation due to the contact and removal of the platen, so that the load variation is more likely to cause color failure or unexpected density variation. On the other hand, in the latter type using the movable platen, when the recording paper initially passes through between the thermal head and the platen, the leading end of the recording paper tends to strike against the thermal head and sometimes get jammed since the thermal head is disposed closer to the paper transport path.

SUMMARY OF THE INVENTION

In view of the foregoing, a prime object of the present invention is to provide a paper transport device for a thermal printer which prevents jamming of the recording paper even where a stationary thermal head is disposed near the paper transport path.

To achieve the prime object, in a thermal printer having a stationary thermal head and a platen movable between a pressing position for pressing the recording paper onto a heating element array of the thermal head and a retracted position off the thermal head, a paper transport device of the present invention is comprised of a platen shift device for shifting the platen between the retracted position and the pressing position, a feed roller device for transporting the recording paper to the thermal head along a transport path, and a guide member disposed between the feed roller device and the thermal head so as to be movable in cooperation with the platen shift device. The guide member moves to a guide position in the transport path and guides the recording paper to remove slantwise from the thermal head while passing through between the thermal head and the platen when the platen shift device shifts the platen to the retracted position the guide member. When the platen shift device shifts the platen to the pressing position the guide member moves to an ineffective position off the transport path.

Because the guide member guides the recording paper to remove slantwise from the thermal head while passing through between the thermal head and the platen, the recording paper is prevented from getting jammed into any gaps or stepped portions of the thermal head. Because the guide member is moved in cooperation with the platen shift device, there is no need for providing a shift mechanism specific to the guide member, so that the guide member will not complicate the construction of the thermal printer.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
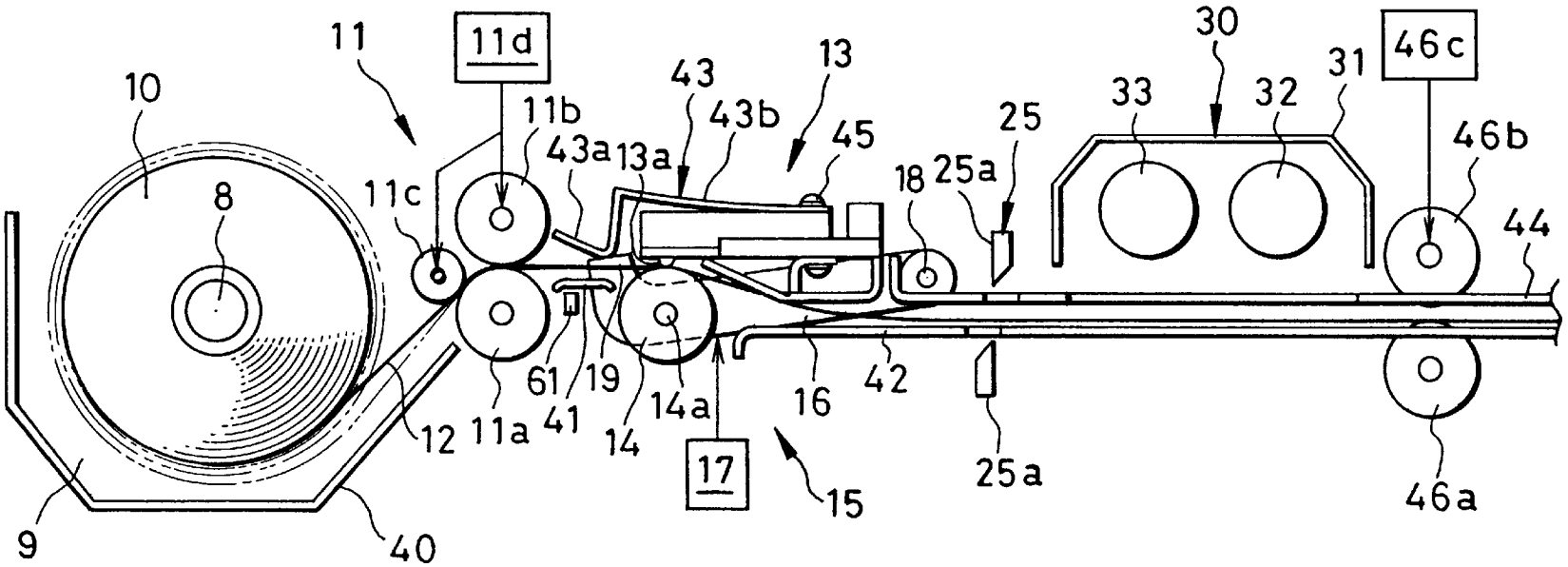
FIG. 1 is a schematic diagram illustrating a single-head reciprocation type direct color thermal printer having a paper transport device according to an embodiment the present invention.

In FIG. 1, a roll 10 of recording paper 12 is fitted onto a shaft 8 in a roll chamber 9 of the printer. The recording paper 12 is pulled out from the roll 10 through a feed roller device 11 toward a thermal head 13. Hereinafter, the direction removing from the roll 10 will be referred to as a forward direction, and the opposite direction as a backward direction. Hereinafter, the relative positions of the elements, such as "leading and trailing", "downstream and upstream" and "before and behind", will be explained with respect to the forward direction. The feed roller device 11 consists of a capstan roller 11*a,* a main press roller 11*b,* a sub-press roller 11*c* and a roller shift mechanism 11*d.* The roller shift mechanism 11*d* moves the two press rollers 11*b* and 11*c* down to the capstan roller 11*a* to nip the recording paper 12. The press rollers 11*b* and 11*c* are moved up by the roller shift mechanism 11*d,* to release the recording paper 12.

The main press roller 11*b* is disposed atop the capstan roller 11*a,* and the sub-press roller 11*c* disposed before the main press roller 11*b,* i.e. on the upstream side. For example, the contact position of the sub-press roller 11*c* with the capstan roller 11*a* is 60 degrees from the top contact position of the main press roller 11*b* with the capstan roller 11*a* in the counterclockwise direction in the drawings, so that the recording paper 12 always turns its direction by 60 degrees around the capstan roller 11*a*. Since the recording paper 12 is curved by the feed roller device 11 in the opposite direction to the counterclockwise winding direction of the roll 10, the recording paper 12 before recording is decurled, i.e. straightened. The turn angle of the recording paper 12 around the capstan roller 11*a* is not to be limited to the above value, but may vary depending upon the thickness and other properties of the recording paper 12.

The recording paper 12 is a color thermosensitive recording paper which has cyan, magenta and yellow coloring layers formed on atop another in this order. The top yellow coloring layer has the highest heat sensitivity, and the bottom cyan coloring layer has the lowest heat sensitivity. The yellow coloring layer is optically fixed by electromagnetic rays of about 420 nm, and the magenta coloring layer is optically fixed by electromagnetic rays of about 365 nm.

Downstream of the feed roller device 11 are disposed a thermal head 13 and a platen roller 14. The thermal head 13 is fixedly mounted to a housing or frame. The platen roller 14 is made of hard rubber, and is rotatable about an axle 14*a*. The axle 14*a* is mounted to a lever device 16 of a platen shift device 15. The lever device 16 is moved by an UP-DOWN mechanism 17, which may be a solenoid 17, to swing about an axle 18 such that the platen roller 14 is movable between an upper pressing position shown in FIG. 1 and a lower retract position shown in FIG. 2A. In the pressing position, the platen roller 14 presses the recording paper 12 against a heating element array 13*a* of the thermal head 13. The axle 18 is mounted to the housing.

The lever device 16 consists of a pair of levers supporting the platen roller 14 at the opposite ends of the axle 14*a,* though only one lever is shown in the drawings for the sake of clarity. The distal ends of the levers 16 are curved upward to form pushing members 19 which are used for pushing up a guide member 43, as will be described later.

Figure 2A:
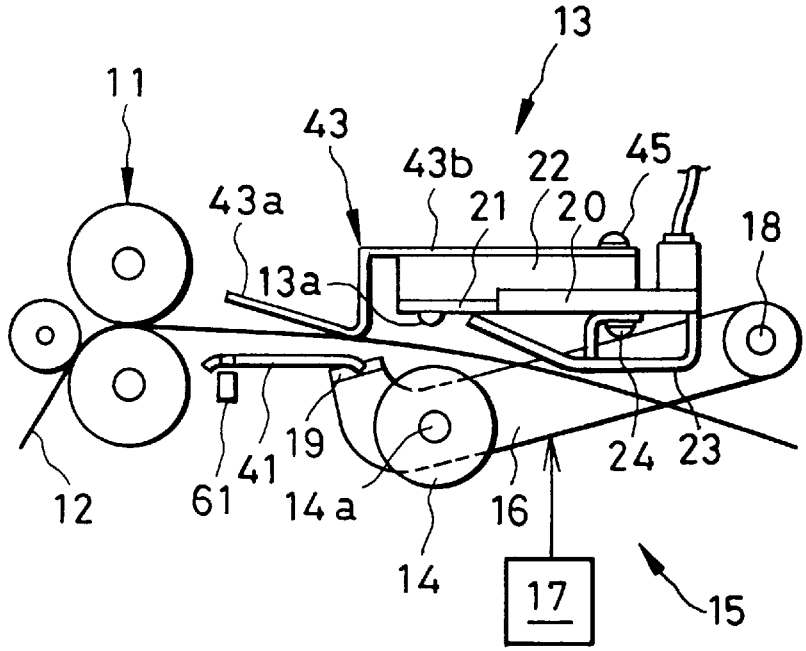
FIGS. 2A and 2B are fragmentary views illustrating the essential portion of the embodiment of FIG. 1 in two different positions.

The heating element array 13*a* consists of a great number of heating elements aligned in the axial direction of the platen roller 14. The heating elements are driven in accordance with image data to record a full-color image on a recording area of the recording paper 12 in a frame sequential fashion. As shown in FIG. 2A, the thermal head 13 is constituted of a head base plate 20 that doubles as a mounting plate, a head main body 21 with the heating element array 13*a,* a radiation plate 22 and a protection cover 23. The head main body 21 is mounted to the head base plate 20 through the radiation plate 22, and the head base plate 20 is secured to the housing. The protection plate 23 is secured by a screw 24 to the head base plate 21, to cover bottom portions of the head base plate 20 and the head main body 21 and protect the wires and the like.

Referring to FIG. 1, a cutter 25 is disposed behind the thermal head 13. The cutter 25 cuts the recording paper 12 into individual sheets of predetermined size. An optical fixing device 30 is disposed behind the cutter 25. The optical fixing device 30 is constituted of a reflector 31, a yellow fixing (Y-fixing) lamp 32 and a magenta fixing (M-fixing) lamp 33. The Y-fixing lamp 32 radiates electromagnetic rays of about 420 nm toward the recording paper 12, to fix the yellow coloring layer before the magenta frame recording. The M-fixing lamp 33 radiates electromagnetic rays of about 365 nm toward the recording paper 12, to fix the magenta coloring layer before the cyan frame recording.

To form a transport path of the recording paper 12, a feed-out guide plate 40, bottom guide plates 41 and 42, the guide member 43 and a top guide plate 44 are provided. The first bottom guide plate 41 is disposed between the capstan roller 11*a* and the platen roller 14. The second bottom guide plate 42 is disposed between the platen roller 14 and a not-shown exit. The top guide plate 44 extends from the thermal head 13 to the exit in parallel to the second bottom guide plate 42. Openings for the cutter 25 and a pair of ejection rollers 46*a* and 46*b* are formed through the top guide plate 44 and the second bottom guide plate 42. The top guide plate 44 further has an opening in front of the optical fixing device 30.

The guide member 43 is a resilient blade consisting of a guide arm portion 43*a* and a supporting portion 43*b*. The guide arm portion 43*a* extends over the first bottom guide plate 41 between the main press roller 11*b* and the thermal head 13, and the supporting portion 43*b* is secured at its distant end from the guide arm portion 43*a* to the top side of the thermal head 13 by a screw 45. The guide arm portion 43*a* is slanted relative to the path of the recording paper 12 such that while the recording paper 12 is fed out from the roll 10 a leading edge of the recording paper 12 comes into contact with the guide arm portion 43*a* and is guided under the thermal head 13, as is shown in FIG. 2A. In this way, the guide member 43 allows the leading edge of the recording paper 12 to pass smoothly through between the thermal head 13 and the platen roller 14 in the retracted position, without the danger of getting jammed into a gap or stepped portion that is formed between the head main body 21 and the protection cover 23.

Figure 2B:
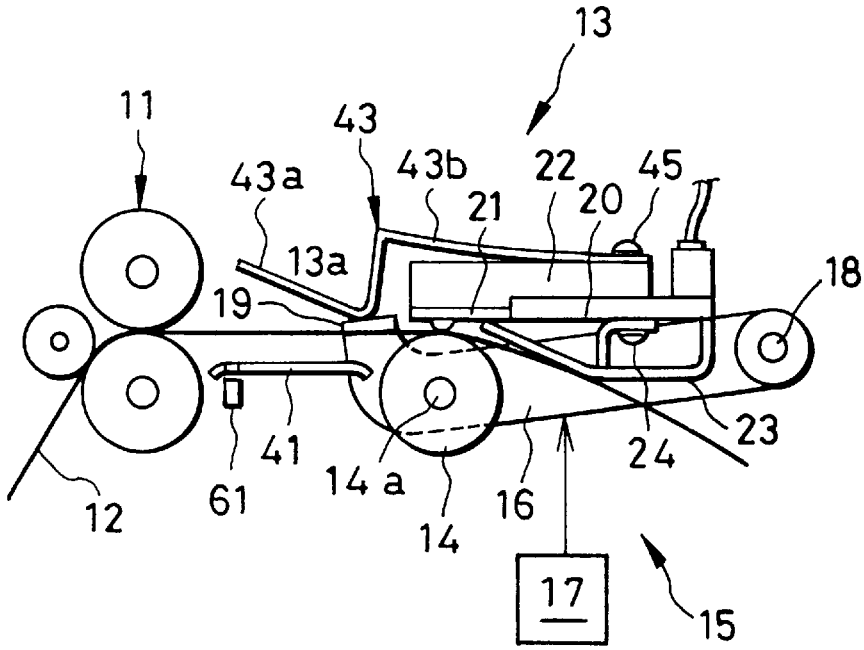

The guide arm portion 43*a* of the guide member 43 is resiliently pushed up by the pushing members 19 when the lever device 16 moves up to the pressing position, as is shown in FIG. 2B. In this way, the guiding portion 43*a* is set to an ineffective position away from the paper transport path. Since the levers of the lever device 16 are disposed on opposite lateral sides of the paper transport path, the pushing members 19 do not interfere the recording paper 12. In the retracted position of the platen roller shown in FIG. 2A, the pushing members 19 are set away from the guide arm portion 43*a,* so that the guide arm portion 43*a* automatically returns to the initial guide position. Therefore, the guide member 43 does not need any specific shift mechanism.

The ejection roller 46*a* is a motor-driven roller, and the ejection roller 46*b* is always retracted from the paper transport path by a roller shift mechanism 46*c* except when to eject the cut paper through the exit.

Figure 3:
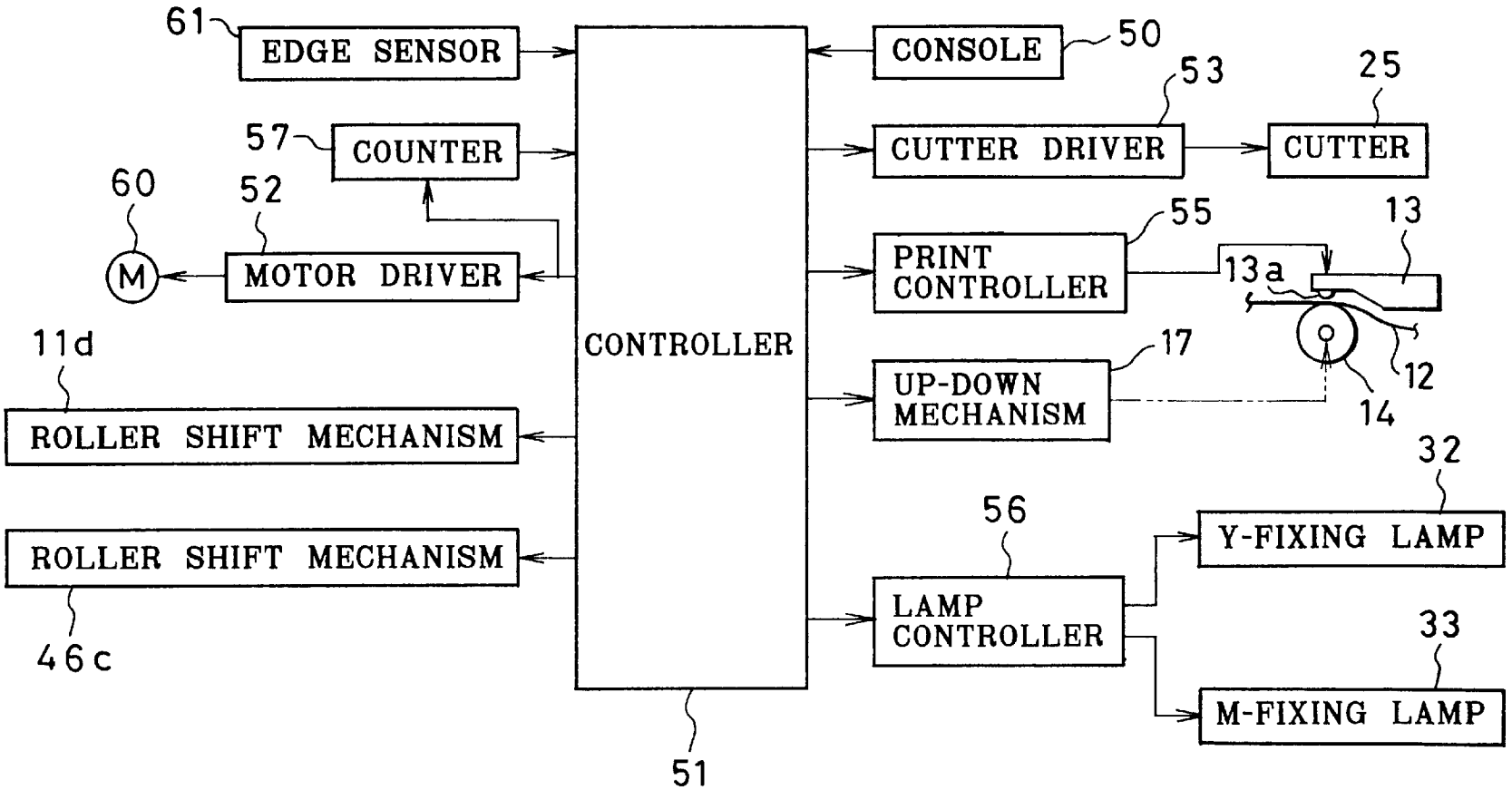
FIG. 3 is a block diagram of the thermal printer of FIG. 1.

FIG. 3 shows the circuitry of the thermal printer of FIG. 1. A console 50 is provided with a keyboard through which various commands and data are fed into a controller 51. The controller 51 controls the UP-DOWN mechanism 17, the roller shift mechanisms 11*d* and 46*c*, a motor driver 52, a cutter driver 53, a print controller 55, a lamp controller 56, and a counter 57. The controller 51 sends a rotational direction signal and drive pulses to the motor driver 52. The motor driver 52 drives a pulse motor 60 to rotate forwardly or reversely, thereby to rotate the capstan roller 11*a* and the ejection roller 46*a* forwardly or reversely. The counter 57 starts counting upon an edge sensor 61 detecting the leading edge of the recording paper 12. The counter 57 counts up so long as the pulse motor 60 rotates forwardly, and counts down during the reverse rotation of the pulse motor 60. The edge sensor 61 is disposed between the feed roller device 11 and the thermal head 13, as shown in FIG. 1.

The cutter driver 53 drives the cutter 25 to cut the recording paper 12 along a given line. The platen shift device 15 moves the platen roller 14 up and down between the pressing position and the retracted position, as set forth above. The print controller 55 includes frame memories storing three color image data and a head driver to drive the heating elements in accordance with the image data. The lamp controller 56 controls the Y- and M-fixing lamps 32 and 33. The roller shift mechanisms 11*d* and 46*c* are each constructed by a solenoid or the like.

Figure 4:
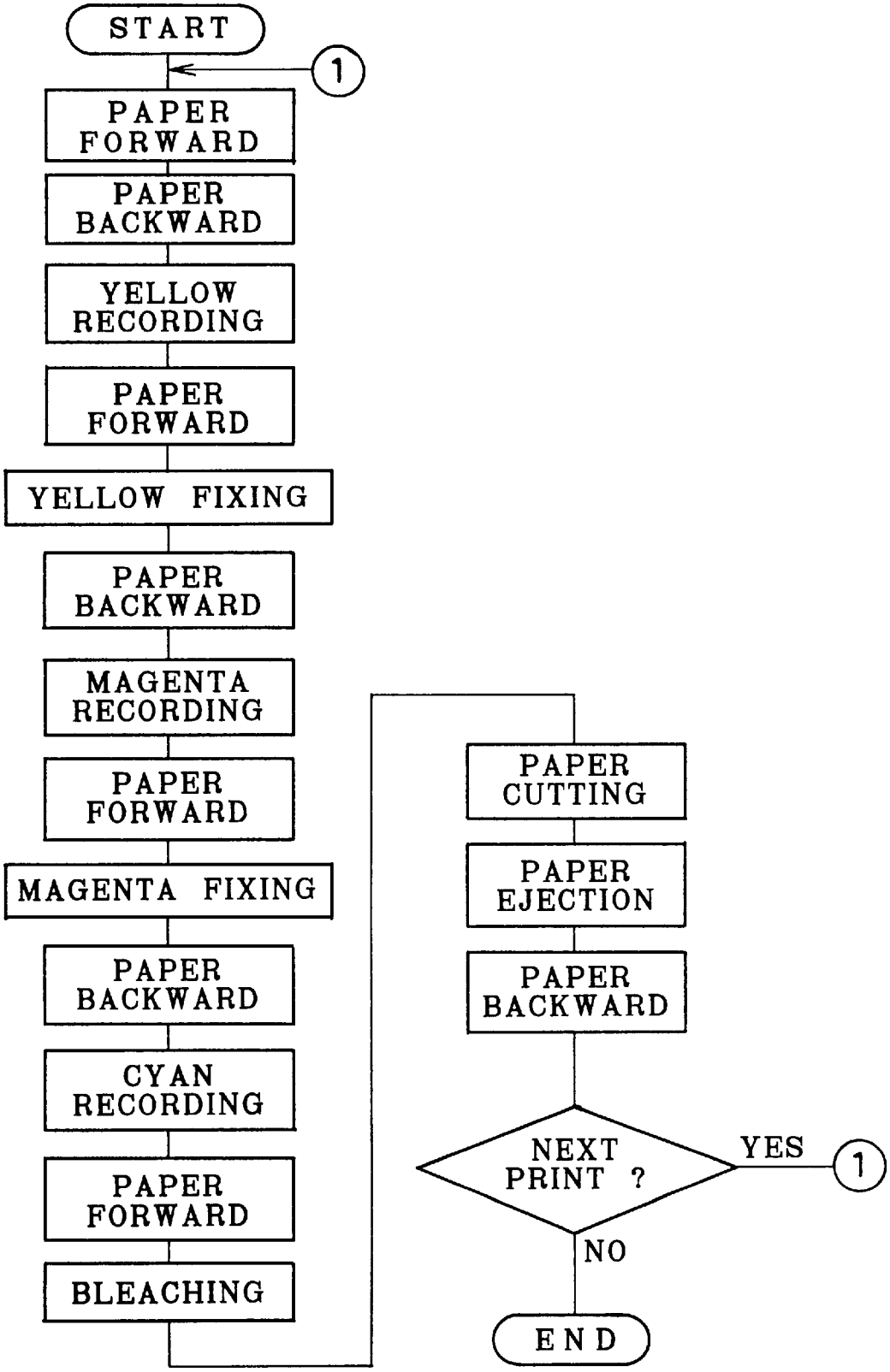
FIG. 4 is a flow chart illustrating the operation of the thermal printer of FIG. 1.

The operation of the thermal printer shown in FIG. 1 will be described with reference to the flow chart shown in FIG. 4.

After entering the image data, a print start signal is entered through the console 50. Then, the controller 51 starts driving the pulse motor 60 to rotate forwardly, so that the feed roller device 11 feeds out the recording paper 12 from the roll 10 toward the thermal head 13. During the initial feeding or preliminary loading of the recording paper 12, the platen roller 14 is set in the retracted position shown in FIG. 2A. Since the pushing members 19 are set away from the guide arm portion 43*a* in this retracted position, the guide arm portion 43*a* is set in the guide position. Therefore, the leading edge of the recording paper 12 is smoothly guided under the thermal head 13 without getting trapped or jammed in the stepped portion of the thermal head 13.

When the leading edge of the recording paper 12 passes by the edge sensor 61, the controller 51 starts the counter 57 to count up synchronously with the transport speed of the recording paper 12 in the forward direction. With reference to the count of the counter 57, the controller 51 detects if the first recording area of the recording paper 12 moves past the heating element array 13*a*, and then stops feeding the recording paper 12.

Thereafter, the controller 51 drives the pulse motor 60 to rotate reversely, to transport the recording paper 12 in the backward direction. During the backward transport, the counter 57 counts down synchronously with the backward transport speed. Based on the count of the counter 57, the controller 51 determines the ends of the recording area. Also during the backward transport, the lever device 16 of the platen shift device 15 moves upward to set the platen roller 14 into the pressing position shown in FIG. 2B, and then the print controller 55 starts driving the heating element array 13*a* in accordance with the yellow image data, to record a yellow frame line by line.

As the lever device 16 moves up, the pushing members 19 push up the guide arm portion 43*a* of the guide member 43 away from the paper transport path, enabling the recording paper 12 to move backward with no problem. The portion of the recording paper 12 that is moved back into the roll chamber 9 is temporarily stored in a room between the roll 10 and the feed-out guide plate 40.

When the edge sensor 61 detects the leading edge of the recording paper 12 on the backward movement, the controller 51 stops transporting the recording paper 12, and resets the counter 57, and then drives the UP-DOWN mechanism 17 to move the lever device 16 downward to set the platen roller 14 in the retracted position shown in FIG. 2A. As the lever device 16 moves down, the pushing members 19 remove from the guide arm portion 43*a*, allowing the guide arm portion 43*a* to return to the initial guide position under the resiliency of the supporting portion 43*b*.

Thereafter, the feed roller device 11 is rotated forwardly to transport the recording paper 12 in the forward direction again, to pass the recording area under the optical fixing device 30. The lamp controller 56 drives the Y-fixing lamp 32 so as to fix the recorded yellow frame in the yellow coloring layer. After the yellow fixing, the feed roller device 11 is rotated reversely to transport the recording paper 12 in the backward direction again. During this backward transport, the magenta frame is recorded line by line in the same recording area as the yellow frame in the same way as described above.

After the magenta frame recording, the recording paper 12 is transported in the forward direction to pass the recording area under the optical fixing device 30. The lamp controller 56 drives the M-fixing lamp 33 so as to fix the recorded magenta frame in the magenta coloring layer. Thereafter, while the recording paper 12 is transported backward, the cyan frame is recorded in the same way as the yellow and magenta frames. Then, the recording paper 12 is transported in the forward direction toward the ejection rollers 46*a* and 46*b*. While the recording paper 12 passes under the optical fixing device 30, the M-fixing lamp 33 is driven to bleach white level portions in the recording area and margins around the recording area, though the cyan coloring layer need not be optically fixed.

When the predetermined position is placed at the cutter 25 while the recording paper 12 is being bleached, the controller 51 stops the recording paper 12, and drives the cutter 25 to cut the recording paper 12 at the predetermined position into a sheet. The controller 51 drives the roller shift mechanism 46*c* to nip the recording paper 12 between the ejection rollers 46*a* and 46*b*, then the rollers 46*a* and 46*b* eject the cut sheet through the exit onto a not-shown tray.

Figure 5A:
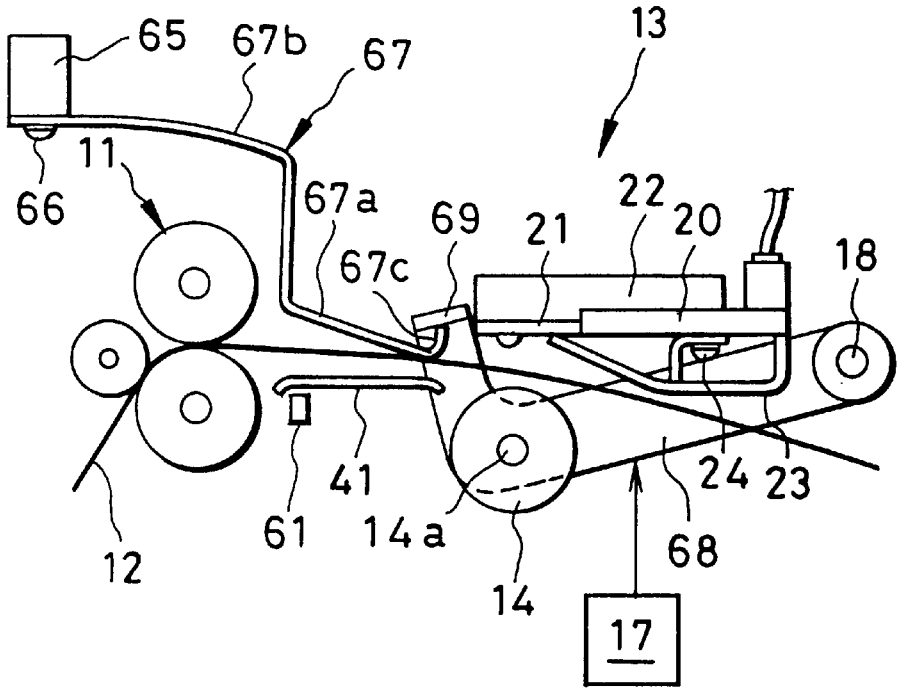
FIGS. 5A and 5B are fragmentary views illustrating a second embodiment of the invention in two different positions.
Figure 5B:
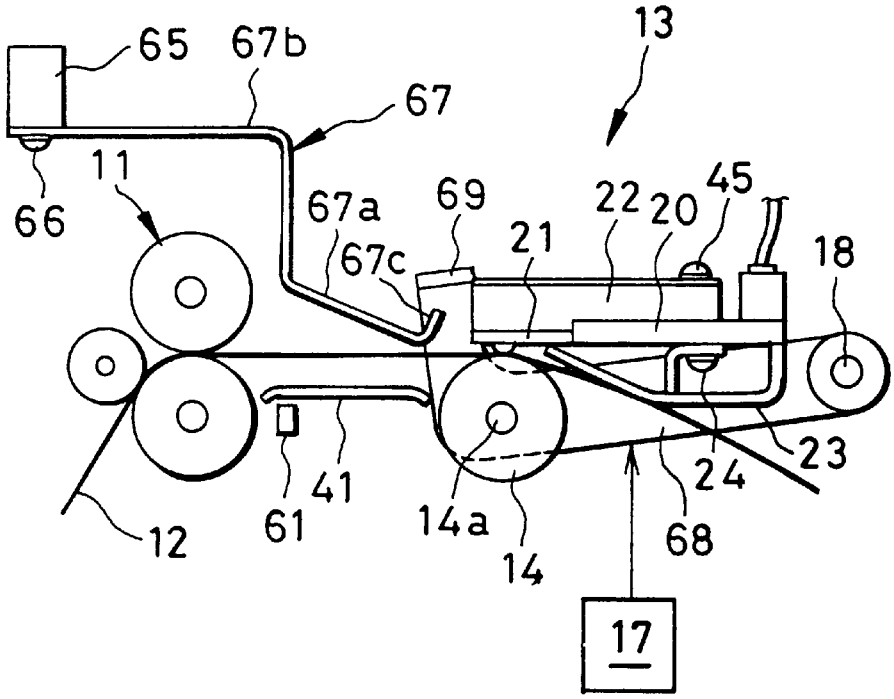

Although the guide member 43 is mounted to the thermal head 13 in the above embodiment, it is possible to mount a guide member 67 to a stay 65 of the housing by a screw 66, as is shown in FIGS. 5A and 5B. Also in this embodiment, a pushing member 69 is formed at a distal end of either lever of a lever device 68 that supports an axle 14*a* of a platen roller 14 in the same way as the lever device 16 of the first embodiment. However, the pushing member 69 is designed to push down a guide arm portion 67*a* of the guide member 67 to a guide position as shown in FIG. 5A.

Specifically, when the lever device 68 sets the platen roller 14 to a retracted position away from a thermal head 13 as shown in FIG. 5A, the pushing members 69 push down the guide member 67 at its free end 67*c*. Due to resiliency of a supporting portion 67*b* of the guide member 67, the guide arm portion 67*a* is set to the guide position. When the lever device 68 brings the platen roller 14 up to a press position for pressing the recording paper 12 against the thermal head, the pushing members 69 remove from the free end 67*c,* so that the guide arm portion 67*a* returns to its initial ineffective position away from the transport path as shown in FIG. 5B, because of the resiliency of the supporting portion 67*b.* Other elements designated by the same reference numbers may be equal to those shown in FIG. 2A.

Although the above embodiments use the guide members 43 and 67 made of resilient blade, the guide member 43 or 67 may be replaced by a movable guide member which is biased toward the guide position or the ineffective position by a separate spring member.

Figure 6A:
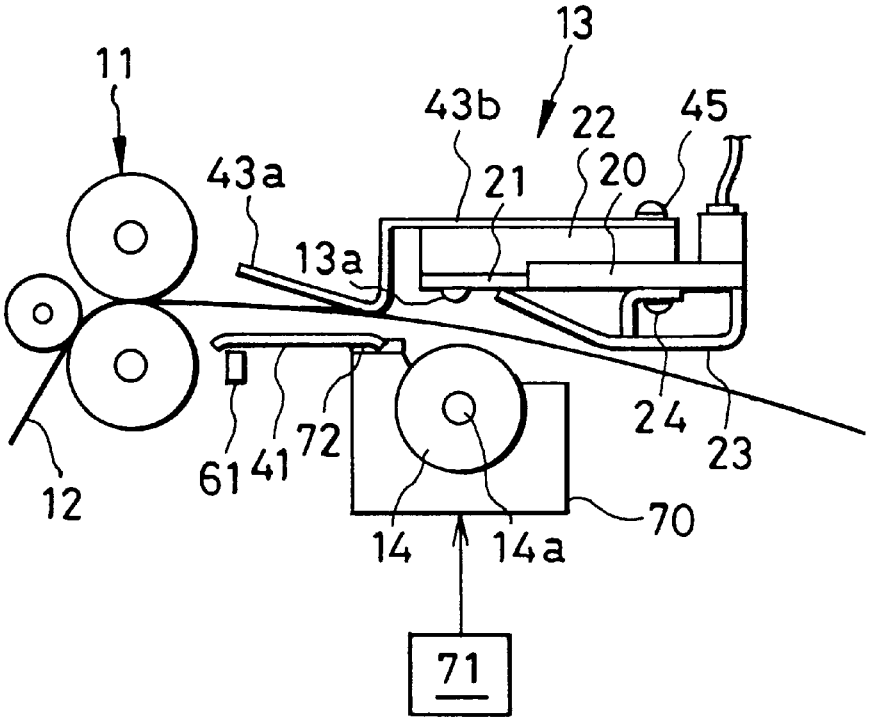
FIGS. 6A and 6B are fragmentary views illustrating a third embodiment of the invention in two different positions.
Figure 6B:
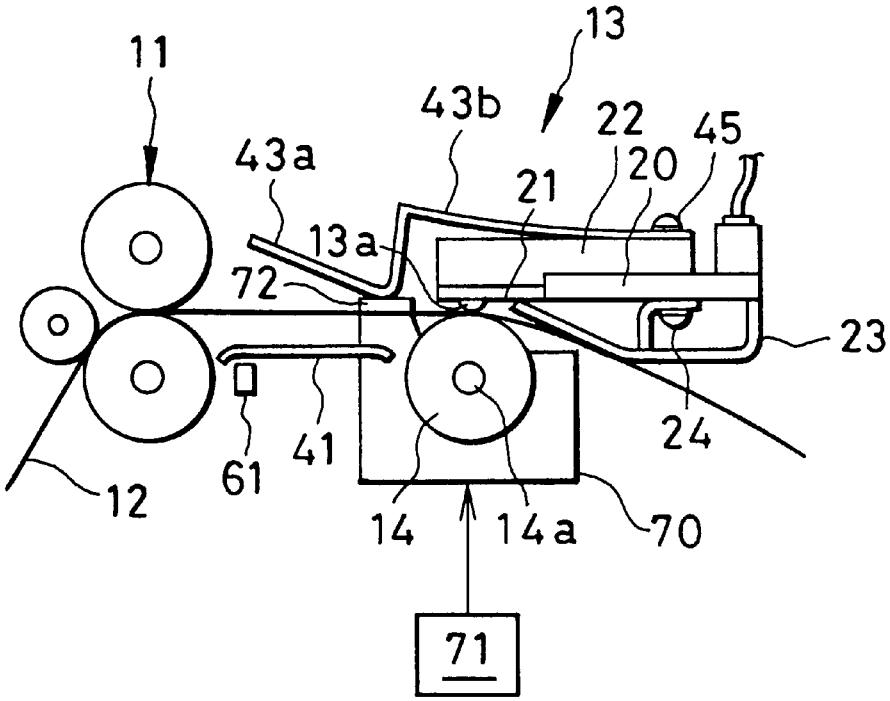

The lever device 16 may be replaced by a sliding holder 70, as shown in FIGS. 6A and 6B. The sliding holder 70 holds a platen roller 14, and is driven by an UP-DOWN mechanism 71 to slide between the upper pressing position and the lower retracted position of the platen roller 14. The UP-DOWN mechanism 71 may be a solenoid, or a cam-motor mechanism. Also in this embodiment, a pushing member 72 is formed on a portion of the sliding holder 70 such that the pushing member pushes up the guide member 43*a* away from the paper transport path when the platen roller 14 is set to the pressing position, as shown in FIG. 6B. This embodiment is applicable also to the embodiment shown in FIGS. 5A and 5B.

Although the above embodiments have been described with respect to those thermal printers wherein the thermal recording is carried out during the backward transportation of the recording paper, it is possible to apply the present invention to a thermal printer wherein the thermal recording is carried out while the recording paper is transported in the forward direction. In that case, a second feed roller pair is disposed between a thermal head and a cutter in addition to the same feed roller device as shown in FIG. 1, and the thermal head is oriented in the opposite direction to the embodiment of FIG. 1. A guide member movable in cooperation with a platen shift mechanism in a similar way to those shown FIGS. 1 or 5A or 6A should be disposed between the second feed roller pair and the thermal head.

The guide member cooperating with the platen shift device of the above embodiments may be applicable to those thermal printers where the recording paper is transported only in one direction, though the above embodiments have been desribed with respect to those thermal printers where the recording paper is transported alternately in opposite directions.

In the above embodiments, the turn angle of the recording paper 12 around the capstan roller 11*a* is maintained constant by the sub-press roller 11*c* used in addition to the main press roller 11*b.* It is possible to omit the sub-press roller 11*c.* However, turning the recording paper 12 around the capstan roller 11*a* at a constant angle is preferable, because it reinforces the feeding power and accuracy of the feed roller device 11, and thus minimizes the color registration failure among the three color frames.

On the other hand, by turning the recording paper 12 around the capstan roller 11*b,* the recording paper 12 is inevitably curled. The degree of curling becomes heavier as the recording paper 12 turns the capstan roller 11*a* right after being heated by the thermal head 13. Accordingly, as shown in FIG. 7A, in a conventional thermal printer wherein the transport direction of the recording paper 12 is reversed as soon as each color frame has been recorded, the recording paper 12 is curled more in a portion 12A that is fed into the feed roller device 11 past the thermal head 13 immediately after the thermal recording, than other portion 12B that is not moved into the feed roller device 11 after the thermal recording.

Figure 7A:
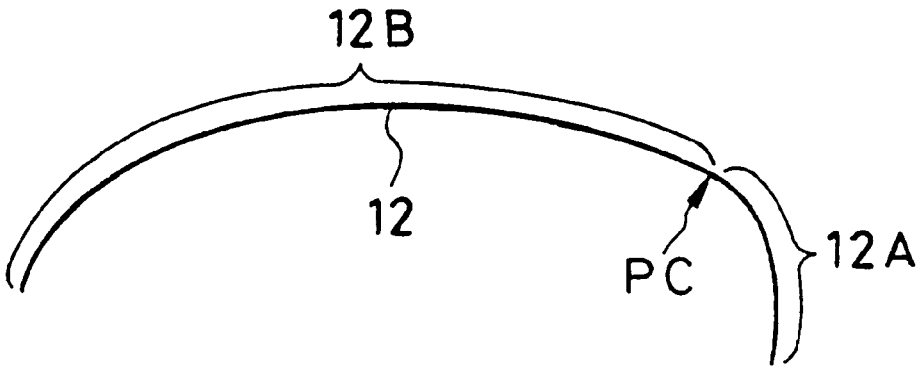
FIG. 7A is an explanatory view of a sheet of recording paper curled through a conventional thermal printer.

If the irregularly curled recording paper 12 as shown in FIG. 7A squeezes through between the thermal head 13 and the platen roller 14 for the next thermal recording, the recording paper 12 tends to get a wrinkle along an inflection point PC where the degree of curling or curvature changes. The wrinkle damages the print appearance and affects the image density by changing the contact condition of the recording paper 12 with the thermal head 13. This problem can arise in any single-head reciprocation type thermal printers where the recording paper turns its path by feed rollers immediately after the thermal printing.

Figure 8:
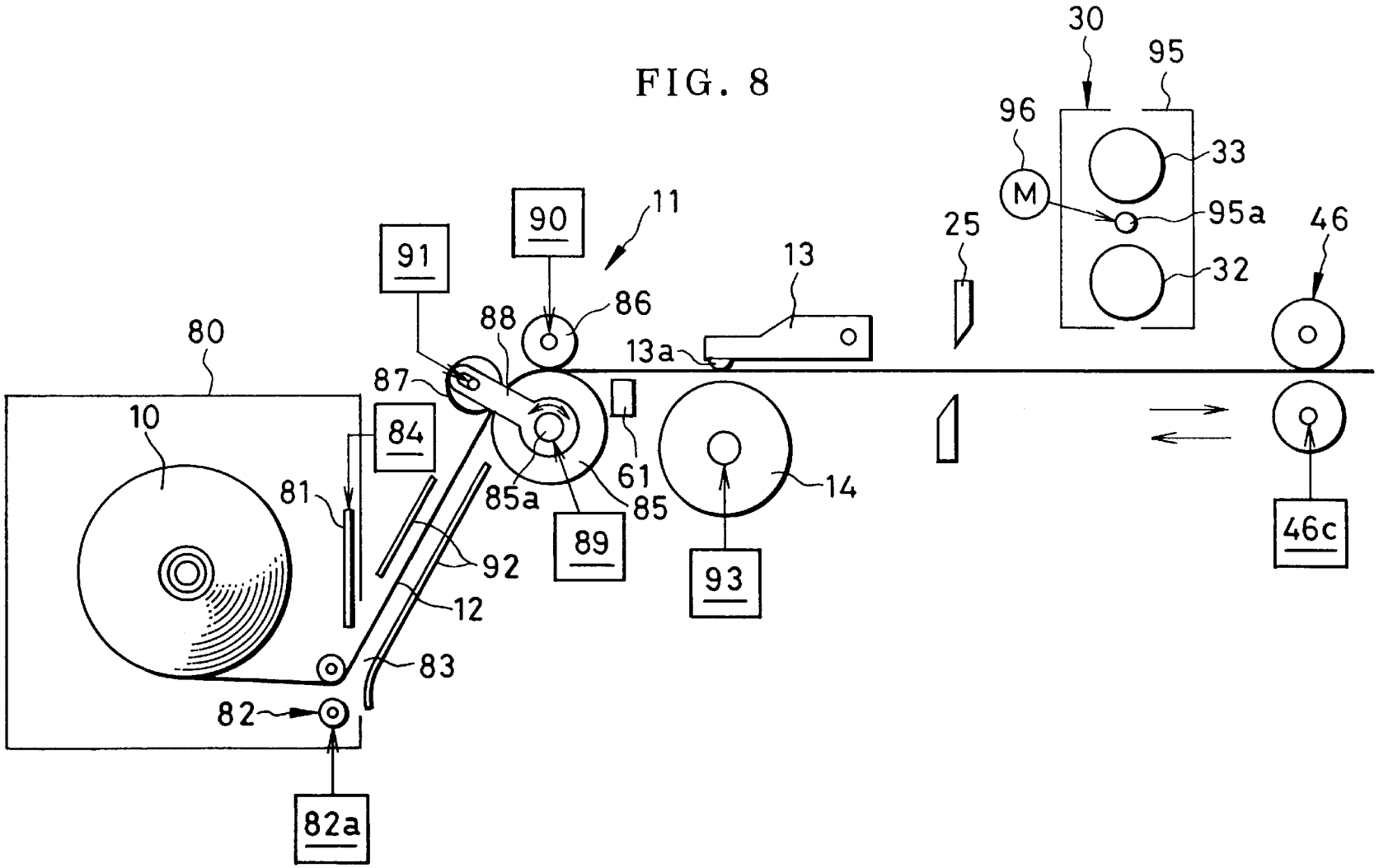
FIG. 8 is a schematic diagram illustrating a single-head reciprocation type direct color thermal printer having a paper transport device according to a fourth embodiment of the present invention.

FIG. 8 shows a direct color thermal printer having a paper transport device that is designed to eliminate the inflection or variation in curling degree of the recording paper and thus prevent the recording paper from being wrinkled. Also in the following embodiments, the same or equivalent elements are designated by the same reference numbers as in the above embodiments, so that the following description will be related to those portions essential to the following embodiments.

In FIG. 8, a roll 10 of recording paper 12 is contained to be rotatable in a paper magazine 80 that has a shutter 81 and a pair of supply rollers 82 at its exit 83. The shutter 81 opens or closes the exit 83, and is biased to the closed position. After the magazine 11 is loaded in the thermal printer, a magazine shutter driver 84 of the thermal printer drives the shutter 81 to open the exit 83.

The supply rollers 82 initially nip the leading end of the recording paper 12, and start rotating after the shutter 81 opens, to feed out the recording paper 12 to a feed roller device 11 of the thermal printer. A roller shift mechanism 82*a* keeps the supply roller pair 82 in the nipping position until the leading end of the recording paper 12 reaches the feed roller device 11 and, thereafter, keeps the supply roller pair 82 in a release position as shown in FIG. 8.

Figure 9:
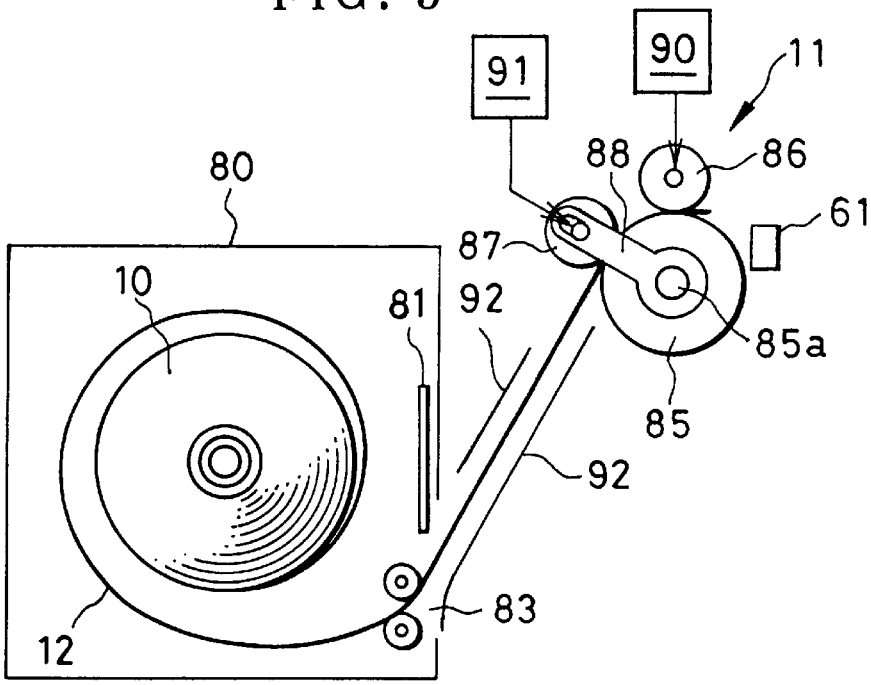
FIG. 9 is a fragmentary view illustrating the essential portion of the embodiment of FIG. 8.

The magazine 80 has a room around the roll 10 even when the roll 10 has its full convolutions, to permit the roll 10 to unwind so as to accept a certain length of the recording paper 12 when it is fed back to the magazine 80 through the feed roller device 11, as is shown in FIG. 9.

The feed roller device 11 has a capstan roller 85, a main press roller 86 and a sub-press roller 87. The sub-press roller 87 pivots on a distal end of a swing arm device 88 which pivots on an axle 85*a* of the capstan roller 85. The swing arm device 88 is moved by an arm shift mechanism 89 that may be constructed by a motor and gears. The angular position of the swing arm device 88 determines the contact position of the sub-press roller 87 on the periphery of the capstan roller 85. The angular or contact position of the main press roller 86 on the periphery of the capstan roller 85 is fixed, so that the turn angle of the recording paper 12 around the capstan roller 85 increases as the swing arm device 88 rotates in the counterclockwise direction in FIG. 8, and decreases as the swing arm device 88 rotates in the clockwise direction.

Roller shift mechanisms 90 and 91 are provided for shifting the main and sub press rollers 86 and 87 between the pressing position and the retracted position, respectively. The roller shift mechanisms 90 and 91 may be constructed by solenoids, or cams driven by a motor. The roller shift mechanisms 90 and 91 set the press rollers 86 and 87 in the retracted position until the leading end of the recording paper 12 is fed into the feed roller device 11 through the supply rollers 82, and thereafter keep the press rollers 86 and 86 in the pressing position to the end of a print sequence.

The feed roller device 11 is disposed diagonally above the exit 83 of the magazine 80. Since the recording paper 12 is curved by the feed roller device 11 in the opposite direction to the winding direction of the roll 10, the recording paper 12 before recording is decurled, i.e. straightened. Guide plates 92 are provided along the diagonal paper transport path between the exit 83 and the feed roller device 11, to guide the recording paper 12 from the exit 83 to the feed roller device 11 and in the opposite direction.

A thermal head 13 and a platen roller 14 are disposed downstream of the feed roller device 11. The thermal head 13 is stationary, whereas the platen roller 14 is movable up and down between an upper pressing position and a lower retracted position through an UP-DOWN mechanism 93.

An optical fixing device 30 is disposed behind a cutter 25 in a downstream portion of the thermal head 13. The optical fixing device 30 has a yellow fixing lamp 32 and a magenta fixing lamp 33 which are mounted in a lamp housing 95. The lamp housing 95 is rotatable about a mounting shaft 95*a* by a rotational power of a motor 96, such that the fixing lamps 32 and 33 are alternatively opposed to the recording paper 12. Although it is not shown but guide plates are provided along the paper transport path between the feed roller device 11 to an exit behind an ejection roller pair 46, in the same way as in the first embodiment shown in FIG. 1. The ejection roller pair 46 is moved by a roller shift mechanism 46*c* from a retracted position to a nipping position only while the recording paper 12 is cut into a sheet and ejected.

Figure 10:
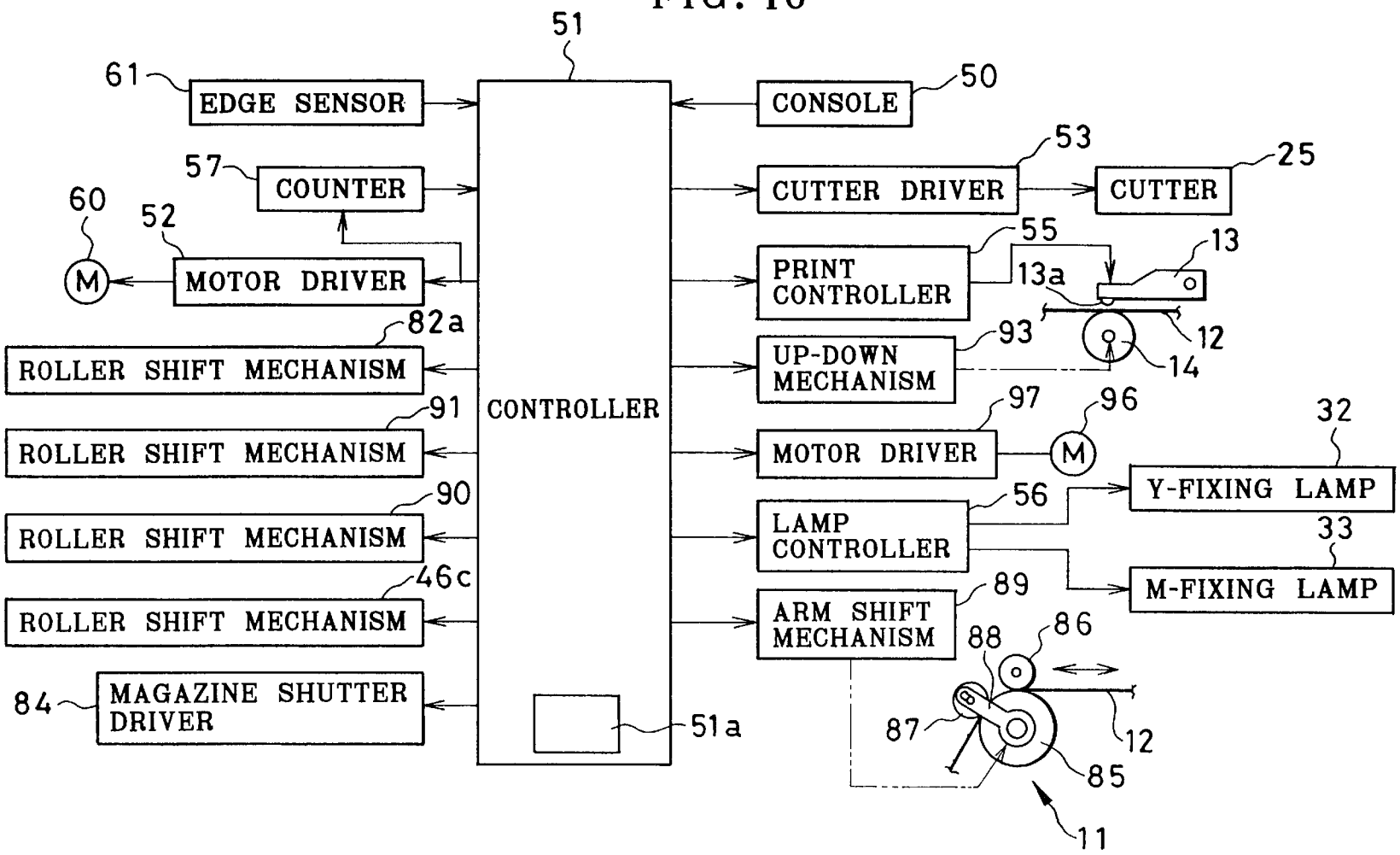
FIG. 10 is a block diagram of the thermal printer of FIG. 8.

FIG. 10 shows the circuitry of the thermal printer of FIG. 8. A controller 51 controls the UP-DOWN mechanism 93 for the platen roller 14, the roller shift mechanisms 46*c,* 90 and 91, a motor driver 52 for a pulse motor 60, a cutter driver 53 for the cutter 25, a print controller 55, a lamp controller 56, and a counter 57, in the same way as in the first embodiment. The controller 51 also controls the roller shift mechanism 82*a,* the magazine shutter driver 84, the arm shift mechanism 89 for the swing arm device 88, and a motor driver 97 for the motor 96 for rotating the lamp housing 95 of the optical fixing device 30.

The paper transport device of the thermal printer shown in FIG. 8 operates as follows:

When a print command is entered through a console 50 after the paper magazine 80 is loaded in the thermal printer and data of an image to print is read in the thermal printer, the controller 51 first opens the shutter 81 through the magazine shutter driver 84. Next, the controller 51 drives the pulse motor 60 through the motor driver 52 to rotate the supply roller pair 82 in a direction to feed out the recording paper 12. When an edge sensor 61 detects the leading edge of the recording paper 12, the controller 51 drives the roller shift mechanisms 90 and 91 to move the press rollers 86 and 87 to the pressing position to nip the recording paper 12. Simultaneously, the counter 57 starts counting drive pulses to the pulse motor 60, to measure the transport amount of the recording paper 12.

Based on the count of the counter 57, the controller 51 determines the leading and trailing ends of each recording area and controls start and stop of the pulse motor 60 and the rotational direction thereof, in the same way as in the first embodiment.

When the recording area reaches a position past the heating element array 13*a* in the forward direction, the recording paper 12 starts to be transported in the backward direction. During the first backward transport, the UP-DOWN mechanism 93 sets the platen roller 14 into the pressing position when a predetermined position reaches under the heating element array 13*a,* and then the print controller 55 starts driving heating elements 13*a,* to record a yellow frame line by line in the recording area in accordance with the yellow image data.

When the yellow frame recording in the recording area is complete, the UP-DOWN mechanism 93 resets the platen roller 14 in the retracted position away from the paper transport path, but the feed roller device 11 continues to transport the recording paper 12 in the backward direction at the same speed as during the thermal recording. First when the edge sensor 61 detects the leading edge of the recording paper 12 on the backward movement, the controller 51 stops transporting the recording paper 12, and resets the counter 57. In this way, the recording paper 12 stops with its leading end nipped between the capstan roller 85 and the main press roller 86, as shown in FIG. 9.

Figure 7B:
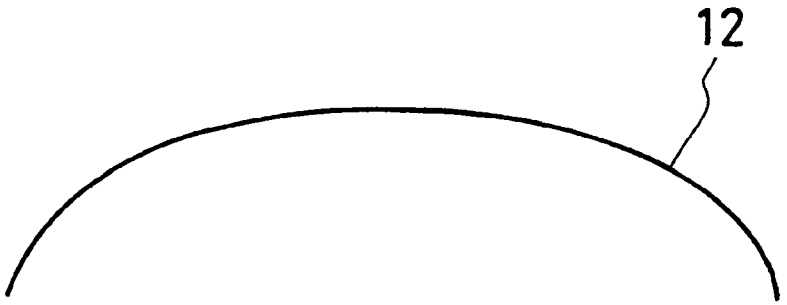
FIG. 7B is an explanatory view of a sheet of recording paper curled through a thermal printer having a paper transport device of the present invention.

Consequently, the recording paper 12 is equally curled along the whole length, as is shown in FIG. 7B. Therefore, the recording paper 12 will not get a wrinkle nor a density variation during the next magenta recording. As described with reference to FIG. 7A, such a wrinkle or a density variation could be provided at the inflection point PC of the recording paper 12, which would be provided if the transport direction of the recording paper 12 is reversed immediately after one frame recording in those thermal printers where the recording paper is turned around the casptan roller which is disposed behind the thermal head in the recording direction, i.e. the backward direction in this embodiment.

After stopping at the position shown in FIG. 9, the feed roller device 11 is again rotated forwardly to transport the recording paper 12 in the forward direction, to pass the recording area under the optical fixing device 30. The lamp controller 56 drives the Y-fixing lamp 32 so as to fix the recorded yellow frame. When the controller 51 determines based on the count of the counter 57 that the whole recording area is exposed to the electromagnetic rays from the Y-fixing lamp 32, the controller 51 stops the feed roller device 11, and turns off the Y-fixing lamp 32. Then, the motor 96 is driven to rotate the lamp housing 95 by 180 degrees to set the M-fixing lamp 33 toward the recording paper 12. Simultaneously, the feed roller device 11 is rotated reversely to transport the recording paper 12 in the backward direction again.

During this backward transport, the magenta frame is recorded line by line in the same recording area as the yellow frame in the same way as above. Also after the completion of the magenta frame recording, the recording paper 12 continues to be transported in the backward direction till the leading edge is detected by the edge sensor 61. In this way, the recording paper 12 is curled uniformly along the whole length, even though higher heat energy is applied to the recording paper 12 for the magenta frame recording than for the yellow frame recording. After the leading edge is detected by the edge sensor 61, the feed roller device 11 restarts feeding the recording paper 12 in the forward direction to pass the recording area under the optical fixing device 30. The lamp controller 56 drives the M-fixing lamp 33 so as to fix the recorded magenta frame.

Thereafter, while the recording paper 12 is transported backward, the cyan frame is recorded in the same way as the yellow and magenta frames. Also after the completion of the cyan frame recording, the recording paper 12 continues to be transported in the backward direction till the leading edge is detected by the edge sensor 61. In this way, the recording paper 12 is curled uniformly along the whole length, even though the highest heat energy is applied to the recording paper 12 for the cyan frame recording. When the edge sensor 61 detects the leading edge, the controller 51 resets the counter 57, and rotates the lamp housing 95 by 180 degrees. Thereafter, the recording paper 12 starts to be transported in the forward direction toward the ejection roller pair 46.

When it is determined based on the count of the counter 57 that the predetermined position is placed at the cutter 25 while the recording paper 12 is transported in the forward direction for the fourth time, the controller 51 stops the recording paper 12, and drives the cutter 25 to cut the recording paper 12 at the predetermined position into a sheet. The controller 51 drives the roller shift mechanism 46*c* to nip the recording paper 12 between the ejection roller pair 46, to eject the cut sheet through the exit onto a not-shown tray.

While the recording paper 12 is transported in the forward direction, the platen roller 14 is retracted from the paper transport path. To print the next image on the same recording paper 12, the controller 51 rotates the feed roller device 11 to transport the recording paper 12 in the forward direction till a trailing end of the next recording area is placed in front of the heating element array 13*a*. Thereafter, the same steps as above are performed.

When the recording paper 12 is replaced by another type of recording paper, the paper type is entered through the console 50. Then, the controller 51 adjusts the turn angle around the capstan roller 85 to the paper type such as the paper's thickness, stiffness and so forth, so that the curling degree of any type recording paper may be maintained uniform. An optimum turn angle for the uniform curling is predetermined to each type of recording paper by experience, and is stored in a memory 51*a* provided in the controller 51. Therefore, the controller 51 refers to the memory 51*a* and drives the arm shift mechanism 89 to change the angular position of the swing arm device 88 and thus that of the sub press roller 87 in accordance with the optimum turn angle for the loaded recording paper.

It is also possible to adjust the turn angle such that the recording paper of any type may be adequately decurled during the preliminary loading. In that case, an optimum turn angle for decurling should be predetermined to each paper type. Although the embodiment shown in FIG. 8 turns off the optical fixing device 30 after the magenta frame fixing, it is possible to drive the M-fixing lamp 33 while the recording paper 12 is being ejected through the exit, to bleach the white level portions and margins out of the recording area in the same way as in the first embodiment.

Figure 12:
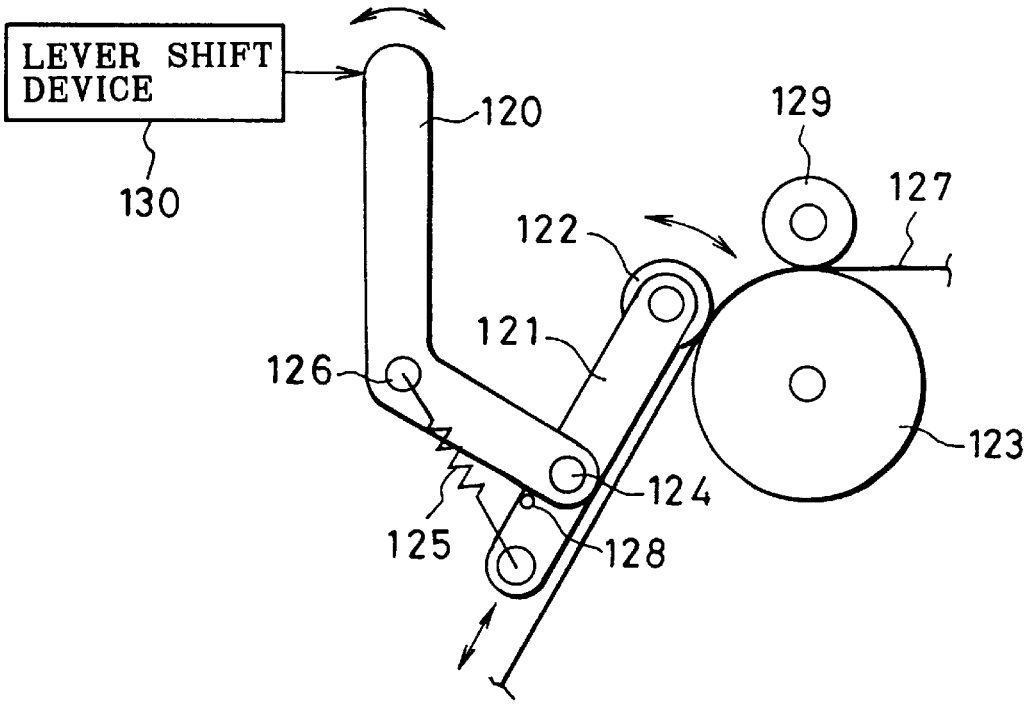
FIG. 12 is a fragmentary view illustrating the essential portion of a sixth embodiment of the present invention.

A combination of the embodiment of FIGS. 8 or 12 with the embodiment of FIGS. 1 or 5A or 6A is preferable, whereby the leading end of the recording paper 12 is prevented from getting jammed into the thermal head 13 even through the leading end is repeatedly transported past the thermal head 13 in the opposite directions according to the embodiments of FIG. 8 and 12.

Figure 11:
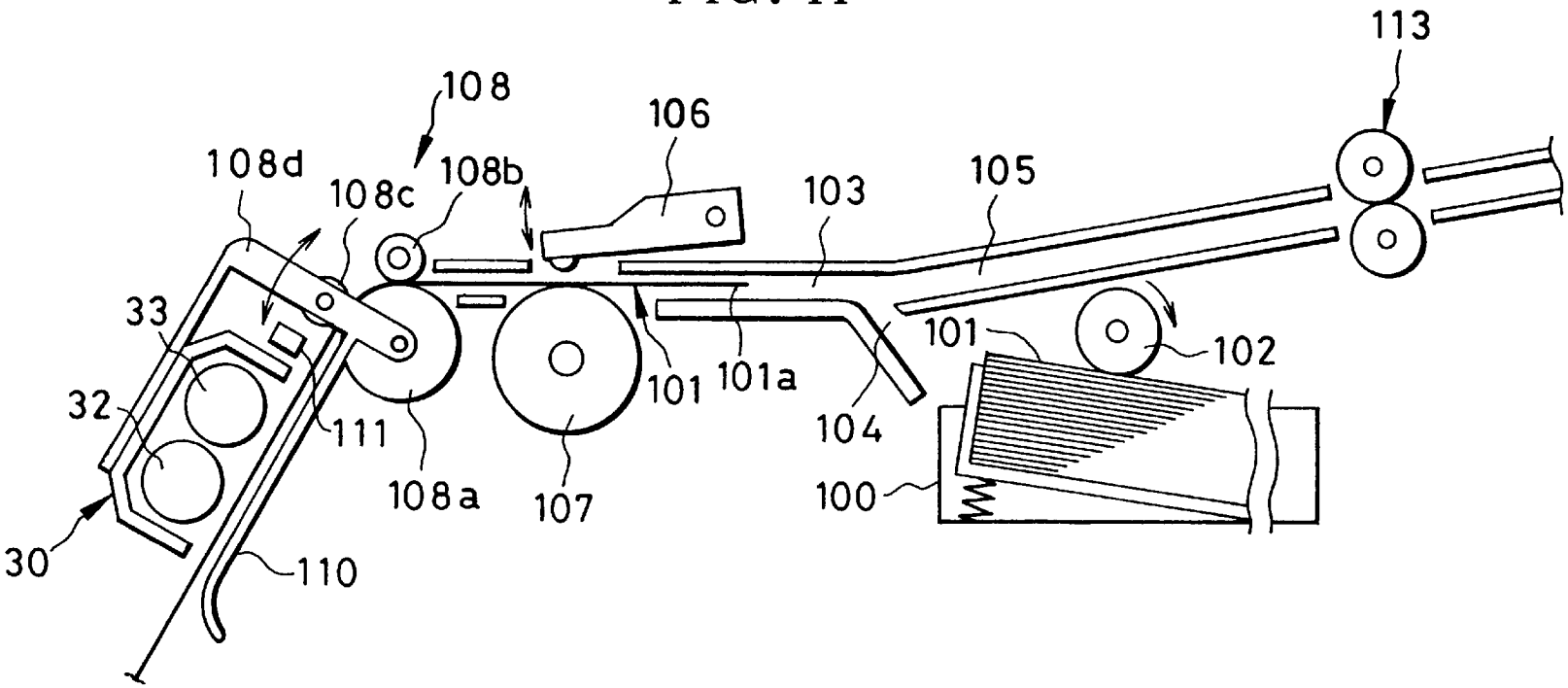
FIG. 11 is a schematic diagram illustrating a single-head reciprocation type direct color thermal printer having a paper transport device according to a fifth embodiment of the present invention.

Although the above embodiments relate to those thermal printers to which the recording paper 12 is supplied from the roll 10, the present invention is applicable to those thermal printers using recording paper previously cut into sheets. In that case, a paper supply roller 102 is disposed in contact with the top of a stack of recording sheets 101 in a supply tray 100, as shown in FIG. 11. The paper supply roller 102 feeds out the recording sheets 101 one after another into a paper transport path 103. A paper supply path 104 is diagonally joined to the paper transport path 103, so that the trailing end of the recording sheet 101 may not be fed back to the paper supply path 104 when the recording sheet 101 should be transported toward an ejection path 105.

According to the embodiment of FIG. 11, the thermal recording is carried out while the recording sheet 101 is transported in the forward direction, i.e. from the supply tray 100 toward a thermal head 106. Behind the thermal head 106 and a platen roller 107 are disposed a feed roller device 108 and an optical fixing device 30 in this order in the forward direction. The recording sheet 101 is sent from the supply tray 100 to the feed roller device 108 past a gap formed between the thermal head 106 and the platen roller 107 when the thermal head 106 is retracted. The feed roller device 108 has a capstan roller 108*a*, a main press roller 108*b* and a sub press roller 108*c*. The sub press roller 108*c* is supported by a swing arm 108*d* such that the turn angle of the recording sheet 101 around the capstan roller 108*a* is adjusted by the position of the sub press roller 108*c*. The swing arm 108*d* pivots on an axle of the capstan roller 108*a*. So as to maintain the distance of the optical fixing device 30 to the recording sheet 101 unchanged even when the turn angle is changed, the optical fixing device 30 and a guide plate 110 are affixed to the swing arm 108*d*. The press rollers 108*b* and 108*c* are movable between a pressing position and a retracted position by a not-shown roller shift mechanism.

When a sensor 111 detects that the leading edge of the recording sheet 101 passes the feed roller device 108, the feed roller device 108 is set to the pressing position to nip the recording sheet 101. Thereafter, the recording sheet 101 is transported by the feed roller device 108. When a recording area reaches to a position near the thermal head 106, the thermal head 106 is set to a pressing position, and then starts recording a yellow frame line by line. The recorded yellow frame is optically fixed by a yellow fixing lamp 32 of the optical fixing device 30. Thereafter the thermal head 106 is retracted, and the capstan roller 108*a* rotates reversely to transport the recording sheet 101 in a backward direction by a predetermined amount. Thereafter, the capstan roller 108*a* starts rotating forwardly again to transport the recording sheet 101, while a magenta frame is recorded line by line in the same recording area. The recorded magenta frame is optically fixed by a magenta fixing lamp 33 of the optical fixing device 30. The recording sheet 101 is transported backward again by the predetermined amount, and then transported forward while a cyan frame is recorded line by line in the same recording area. After the cyan frame recording, the recording sheet 101 is transported backward into the ejection path 105, and is ejected through a pair of ejection rollers 113.

Also in this embodiment, the recording sheet 101 continues to be transported for a while after the thermal recording until a trailing end 101*a* of the recording sheet 101 moves closer to the feed roller device 108. Accordingly, the curling degree is almost uniform along the length of the recording sheet 101, so that any inflection point is not formed in the recording sheet 101. The optical fixing device 30 and the guide plate 110 may be mounted stationary. In that case, guide rollers should be provided for maintaining a constant distance between the optical fixing device and the recording sheet, independently of the turn angle of the recording sheet.

Although the recording paper 12 or the recording sheet 101 are turned around the capstan roller 11*a*, 85 or 108 by means of the main press roller 11*b*, 86 or 108*b* and the sub press roller 11*c*, 87 or 108*c*, it is possible to replace the main press roller by another kind of pressing member such as a guide member biased by a spring force or a resilient guide member.

FIG. 12 shows another embodiment of a mechanism for changing the position of a sub press roller 122 relative to a capstan roller 123. The mechanism is constituted of first and second levers 120 and 121. The sub press roller 122 is mounted to an end of the second lever 121 in a rotatable fashion, and the second lever 121 is mounted to an end of the first lever 120 so as to be rotatable about a mounting shaft 124. A coiled spring 125 is suspended between the other end of the second lever 121 and a pivot 126 of the first lever 120, to urge the second lever 121 to rotate in a direction to press the sub press roller 122 onto the capstan roller 123. The first lever 120 is rotated about the pivot 126 by a lever shift device 130, thereby to change the contact position of the sub press roller 122 with the capstan roller 123 relative to the contact position of a main press roller 129 with the capstan roller 123, and thus the turn angle of recording paper 127 around the capstan roller 123. As the first lever 120 rotates in the counterclockwise direction, the turn angle decreases.

A stopper 128 is provided on the second lever 121 to limit the rotational angle of the second lever 121 in the clockwise direction in FIG. 12. Accordingly, when the turn angle goes below a minimum value as the result of the counterclockwise rotation of the first lever 120, the sub press roller 122 removes from the capstan roller 123. In this way, the mechanism of this embodiment doubles as the turn angle changing mechanism and the roller shift mechanism for the sub press roller 122. One longitudinal surface of the second lever 121 that faces the recording sheet 127 also functions as a guide surface for the recording sheet 127.

Although the above embodiments use a pair of rollers as members for pressing the recording paper onto the capstan roller, one or both of the rollers may be replaced by a guide plate or a shaft extending laterally to the recording paper. The guide plate may be stationary or movable. The shaft may be stationary and unrotatable, or stationary but rotatable, or movable and rotatable, or movable but unrotatable. Where it is unnecessary to adjust the turn angle of the recording paper around the capstan roller, it is possible to use one of these elements as a single pressing member for the capstan roller.

The paper transport speed can be equal in both directions, but it is preferable to use a higher speed for the forward direction when the thermal recording is carried out during the backward transportation. In case of the thermosensitive recording paper 12, it is also preferable to use the higher transport speed for the thermal recording in the higher heat sensitive coloring layer.

Although the above embodiments execute the optical fixing process while the recording paper or sheet is transported in one direction, it is possible to effect the optical fixing in both transport directions. It is also possible to provide the optical fixing device 30 with a shutter that is disclosed for example in U.S. Pat. No. 5,629,729.

It is possible to use a stationary platen plate in place of the platen roller 107. As for those embodiments which use the paper roll 10, it is possible to provide a paper looping section between the feed roller device and the roll 10 for accepting the recording paper 12 during the backward transportation, instead of receiving it in the room around the roll 10. It is alternatively possible to rotate the roll 10 to wind up the recording paper 12 during the backward transportation. The supply rollers, the feed rollers and the ejection rollers may be kept in the nipping positions, and rotated at the same transport speed in the same transport direction. The positions of the cutter and the optical fixing device may be modified appropriately.

The present invention is applicable not only to the direct thermal printers as above, but also to the thermal transfer printers. The present invention is also applicable to those thermal printers where the recording paper or sheet is transported vertically or diagonally, though the drawings illustrate it as being transported horizontally.

Thus, the present invention should not be limited to the above described embodiments but, on the contrary, various modification may be possible to those skilled in the art without departing from the scope of claims attached hereto.

What is claimed is:

1. A paper transport device for a thermal printer having a stationary thermal head and a platen movable between a pressing position for pressing a recording paper onto a heating element array of the thermal head and a retracted position off the thermal head, the paper transport device comprising:

a platen shift device for shifting the platen between the retracted position and the pressing position;

a feed roller device for transporting the recording paper to the thermal head along a transport path; and a guide member disposed between the feed roller device and the thermal head which moves in cooperation with the platen shift device, such that when the platen shift device shifts the platen to the retracted position the guide member moves to a guide position in the transport path and guides the recording paper to remove slantwise from the thermal head while passing through between the thermal head and the platen, and when the platen shift device shifts the platen to the pressing position the guide member moves to an unguiding position off the transport path.

2. The paper transport device as claimed in claim 1, wherein the guide member comprises a guiding portion extending diagonally to the transport path in the guide position, and a supporting portion for supporting the guiding portion.

3. The paper transport device as claimed in claim 2, wherein the guide member is biased toward one of the guide position and the unguiding position, and is actuated by the platen shift device to move to the other one of the guide position and the unguiding position against the biasing force.

4. The paper transport device as claimed in claim 3, the supporting portion is made of a resilient material and is deformable by the platen shift device in a direction to bring the guiding portion from the one of the guide position and the unguiding position to the other of the guide position and the unguiding position.

5. The paper transport device as claimed in claim 4, wherein the guide member is formed as an integral plate and is mounted to the thermal head.

6. The paper transport device as claimed in claim 1, wherein the feed roller device transports the recording paper alternately in opposite directions along the transport path, and the platen shift device shifts the platen to the retracted position while the recording paper is transported in one direction of the opposite directions, from the feed roller to the thermal head, and to the pressing position prior to a start of recording while the recording paper is transported in the other direction of the opposite directions.

7. The paper transport device as claimed in claim 6, wherein the feed roller device passes the recording paper through the thermal head at least three times in either direction to record at least three color frames in a recording area on the recording paper.

8. A paper transport device for transporting recording paper through a color thermal printer with a thermal head alternately in a recording direction and in an opposite direction, wherein the thermal head records one color frame at one transport in the recording direction to record at least three color frames in a recording area on the recording paper, the transport device comprising:

a feed roller device disposed behind the thermal head in the recording direction to transport the recording paper in the opposite direction, the feed roller device comprising a capstan roller and a press member for pressing the recording paper onto the capstan roller;

a driving device for driving the feed roller device such that the feed roller device continues transporting the recording paper in the recording direction till at least the recording area has passed through the feed roller device; and a subsidiary press member for pressing the recording paper on the capstan roller, a contact position of the subsidiary press member with the capstan roller having a given angle to that of the press member so as to make the recording paper turn the capstan roller at the given angle.

9. The paper transport device as claimed in claim 8, wherein the recording direction is a direction from a paper supply section to the thermal head.

10. The paper transport device as claimed in claim 8, wherein at least one of the press member and the subsidiary press member is a movable press roller.

11. The paper transport device as claimed in claim 8, wherein at least one of the press member and the subsidiary press member is a stationary guide member.

12. The paper transport device as claimed in claim 8, wherein at least one of the press member and the subsidiary press member is a stationary shaft.

13. The paper transport device as claimed in claim 8, wherein at least one of the press member and the subsidiary press member is a shaft movable between a pressing position and a retracted position.

14. The paper transport device as claimed in claim 8, wherein at least one of the press member and the subsidiary press member is a rotatable shaft.

15. The paper transport device as claimed in claim 8, wherein at least one of the press member and the subsidiary press member is a rotatable shaft which is also movable between a pressing position and a retracted position.

16. The paper transport device as claimed in claim 8, wherein the recording direction is a direction from the thermal head to a paper supply section.

17. The paper transport device as claimed in claim 16, wherein the recording paper is withdrawn from a roll that is loaded in the paper supply section, and is turned around the capstan roller in a direction opposite to a winding direction of the recording paper into the roll, so as to straighten the recording paper before recording.

18. The paper transport device as claimed in claim 8, wherein the press member is a press roller movable between a pressing position and a retracted position.

19. The paper transport device as claimed in claim 18, wherein the subsidiary press member is a stationary guide member.

20. The paper transport device as claimed in claim 18, wherein the press member is a guide member movable between a pressing position and a retracted position.

21. The paper transport device as claimed in claim 18, wherein the subsidiary press member is a stationary shaft.

22. The paper transport device as claimed in claim 18, wherein the subsidiary press member is a shaft movable between a pressing position and a retracted position.

23. The paper transport device as claimed in claim 18, wherein the subsidiary press member is a rotatable shaft.

24. The paper transport device as claimed in claim 18, wherein the subsidiary press member is a rotatable shaft which is also movable between a pressing position and a retracted position.

25. A method of transporting recording paper through a thermal printer by a feed roller device having a capstan roller around which the recording paper turns by means of at least a press member and a subsidiary press member, and a thermal head which records at least three color frames in a recording area on the recording paper, said feed roller device being disposed behind the thermal head in a recording direction, comprising the steps of:

A. transporting the recording paper in the recording direction while the thermal head records one color frame;

B. thereafter continuing transporting the recording paper further in the recording direction till at least the recording area has passed through roller device;

C. transporting the recording paper in an opposite direction to the recording direction by the feed roller device till the recording area has passed through a heating element array of the thermal head; and D. repeating steps A to C so as to record at least three color frames in the recording area;

wherein the recording paper is turned around the capstan roller by a pair of press members for pressing the recording paper onto the capstan roller, the pair of press members being disposed around the capstan roller and spaced in the recording direction, the method further comprising the step of changing a turn angle of the recording paper around the capstan roller by changing contact positions of the press members with the capstan roller in relation to each other.

26. The method as claimed in claim 25, wherein the thermal head is brought into contact with the recording paper one of before and when the recording area moves to the heating element array of the thermal head, and is separated from the recording paper after the recording area pass through the heating element array, while the recording paper continues being transported in the recording direction.

27. The method as claimed in claim 25, wherein the feed roller device transports the recording paper at a same speed in step B as in step A, and wherein each color frame is a heat sensitive recording layer requiring a different application of heat energy, and the speed of transport by the feed roller device is determined for each color frame by using a higher speed for recording on the heat sensitive recording layer requiring a higher application of heat energy.

28. A paper transport device for transporting recording paper through a color thermal printer with a thermal head alternately in a recording direction and in an opposite direction, wherein the thermal head records one color frame at one transport in the recording direction to record at least three color frames in a recording area on the recording paper, the transport device comprising:

a feed roller device disposed behind the thermal head in the recording direction to transport the recording paper in the opposite direction, the feed roller device comprising a capstan roller and a press member for pressing the recording paper onto the capstan roller;

a driving device for driving the feed roller device such that the feed roller device continues transporting the recording paper in the recording direction till at least the recording area has passed through the feed roller device;

a subsidiary press member for pressing the recording paper on the capstan roller, a contact position of the subsidiary press member with the capstan roller having a given angle to that of the press member so as to make the recording paper turn the capstan roller at the given angle; and a device which changes the given angle by moving an angular position of the subsidiary press member in relation to the press member.

29. A method of transporting recording paper through a thermal printer by a feed roller device having a capstan roller around which the recording paper turns, and a thermal head records at least three color frames in a recording area on the recording paper, comprising the steps of:

A. transporting the recording paper in a recording direction while the thermal head records one color frame;

B. thereafter continuing transporting the recording paper further in the recording direction till at least the recording area has passed through the feed roller device;

C. transporting the recording paper in an opposite direction to the recording direction by the feed roller device till the recording area has passed through a heating element array of the thermal head; and D. repeating steps A to C so as to record at least three color frames in the recording area;

wherein the recording paper is turned around the capstan roller by a pair of press members for pressing the recording paper onto the capstan roller, the pair of press members being disposed around the capstan roller and spaced in the recording direction, the method further comprising the step of changing a turn angle of the recording paper around the capstan roller by changing contact positions of the press members with the capstan roller in relation to each other.

* * * * *